United States Patent [19]

Mangan et al.

[11] Patent Number: 4,793,540

[45] Date of Patent: Dec. 27, 1988

[54] PALLET SYSTEM

[75] Inventors: Steven J. Mangan, Xenia; James L. May, Greenville, both of Ohio

[73] Assignee: Accurate Tool and Manufacturing, Inc., Dayton, Ohio

[21] Appl. No.: 8,710

[22] Filed: Jan. 29, 1987

[51] Int. Cl.[4] ..... B27F 7/02

[52] U.S. Cl. ..... 227/7; 227/100; 227/39; 29/432; 29/798

[58] Field of Search ..... 227/5, 40, 76, 50, 99, 227/4, 6, 7, 150, 100, 39, 101, 44, 45; 29/705, 707, 709, 711, 432, 712, 772, 798, 799

[56] References Cited

U.S. PATENT DOCUMENTS

| | | | |
|---|---|---|---|
| 3,046,558 | 7/1962 | Hadnagy | 227/139 |
| 3,637,126 | 1/1972 | Heterick, Jr. | 227/40 |
| 3,763,547 | 10/1973 | Blakeslee | 227/45 |
| 3,765,587 | 10/1973 | Davis | 227/45 |
| 3,844,466 | 10/1974 | Narita et al. | 227/40 |
| 3,945,549 | 3/1976 | Colson | 227/45 |
| 3,968,560 | 7/1976 | Vial | 227/45 |
| 4,039,111 | 8/1977 | Rogers | 227/101 |
| 4,204,624 | 5/1980 | Gunn et al. | 227/50 |
| 4,403,388 | 9/1983 | Belcher | 227/40 |
| 4,478,361 | 10/1984 | McElhannon | 227/45 |

*Primary Examiner*—Frank T. Yost
*Assistant Examiner*—James L. Wolfe
*Attorney, Agent, or Firm*—Biebel, French & Nauman

[57] ABSTRACT

A pallet assembling apparatus includes a fixture into which the pallet stringers and top and bottom slats are loaded manually, and a nailing station, including opposed pairs of top and bottom nailing guns equal in number to the number of stringers loaded in the fixture, for nailing the top and bottom slats to the top and bottom surfaces of each of the stringers. The fixture is movable along rails past the nailing station, and actuating bosses equal in number to the number of top and bottom slats in the fixture project from the fixture and trip proximity switches as the fixture moves through the nailing station to cause the nailing guns to be fired in unison as each slat passes by them, and a pickup carriage, positioned downstream of the nailing station, removes completed pallets from the fixture.

15 Claims, 11 Drawing Sheets

PALLET SYSTEM

BACKGROUND OF THE INVENTION

Pallets, particularly wooden pallets, are utilized in vast numbers for shipping, storage and handling of a wide variety of products. During such operations pallets are frequently damaged and generally have a relatively short useful life, requiring a continuous supply of replacement pallets in substantial quantities.

Construction of such pallets was originally accomplished in a totally manual operation, perhaps assisted by a jig to position the pallet components in their desired relationship preparatory to nailing or otherwise securing them to each other.

At the other end of the spectrum, massive automated systems have been provided at an expense of hundreds of thousands of dollars to produce pallets on a continuous, automated basis.

Thus, while the demand for pallets continues unabated, the high volume production required to satisfy this demand has necessitated huge capital expenditures or a highly labor-intensive work force.

SUMMARY OF THE INVENTION

The present invention provides a system for producing wooden pallets on a relatively high volume basis, but without the attendant massive machinery and expense heretofor associated with producing pallets in substantial quantities.

Thus, the present invention provides machine which can be operated with minimal manual labor requirements and at an expense only a fraction of fully automated systems such as those noted above, but which nonetheless provides a continuous production of pallets in substantial quantities.

As will be seen in the ensuing description, the present invention provides a fixture into which the pallet components, namely, the slats and stringers, are loaded manually, and thereafter the fixture is moved past a nailing station having opposed pairs of upper and lower nailing guns, which operate in unison to nail each successive upper and lower slat as it moves through the nailing station to the upper and lower surfaces, respectively, of the stringers.

The pairs of nailing guns are equal in number to the number of stringers in the pallet, and the fixture is provided with actuating means equal in number to the number of slats in the pallet which actuate switches which in turn trigger the nailing guns as the slats move past them, resulting in each slat being nailed simultaneously to all of the stringers as that particular slat moves past the guns.

The fixture is mounted for continuous movement from a loading station past the nailing station and to an unloading station, where the completed pallet is unloaded, and then recycled back to the loading station for reloading with additional slats and stringers for the next pass past the nailing station.

As a result, the present invention permits assembly of pallets with minimal manual labor and relatively low cost, but on a high volume, continuous basis.

DESCRIPTION OF THE PREFERRED EMBODIMENTS

Figure 1:
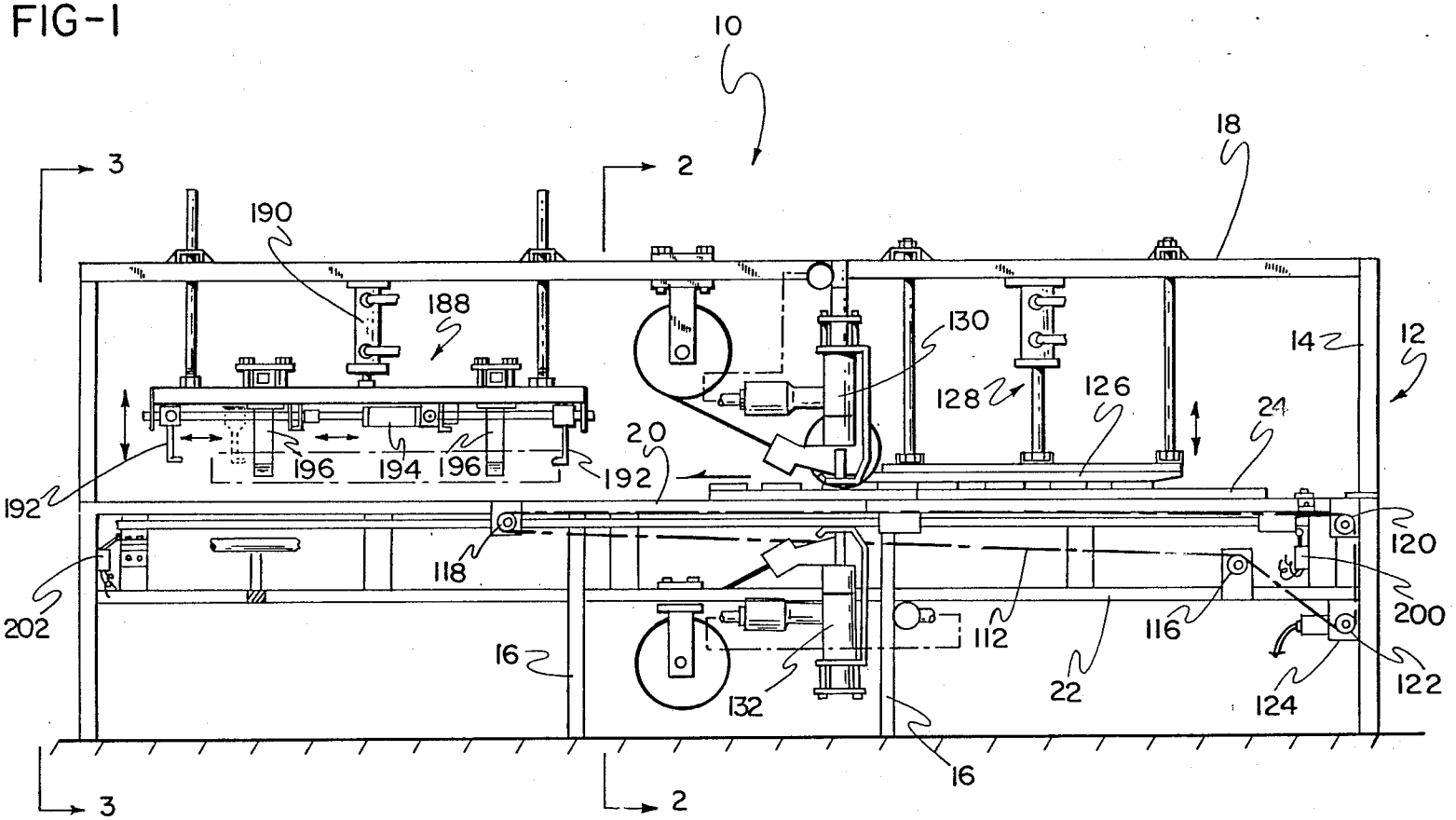
FIG. 1 is an elevational view of the apparatus of the present invention.

With reference initially to FIG. 1 of the drawings, it will be seen that the apparatus 10 of the present invention includes three primary stations: a loading station, a nailing station and a pickoff station. All three stations are supported on a main frame 12, consisting of uprights 14 and 16, and horizontal structural members 18, 20 and 22, interconnected by appropriate cross bracing, not specifically referenced.

At the loading station a fixture 24 (see FIGS. 4 through 8) is initially positioned to receive the pallet components. Fixture 24 includes longitudinally extending, box-shaped side rails 26 and 28 and pairs of spaced apart, box-shaped cross members 30 and 32. Secondary side rails 34 and 36 are mounted by means of bolts 38 and washers 40 for movement along the pairs of cross members 30 and 32 Thus, bolts 38 may be loosened and secondary side rails 34 and 36 moved inwardly or outwardly of the fixture as desired, and then the bolts 38 retightened to fix the secondary side rails 34 and 36 in their preselected position.

Additional box-shaped structural members 42 and 44 also are provided with bolts 38 and enlarged washers 40 for adjustment along cross members 30 and 32 in the same manner described above for secondary side rails 34 and 36. The pairs of structural members 42 and 44 carry channel members 46 and angle members 48, both of which have upstanding flanges, as at 50, to define a first set of locators for receiving and positioning bottom slats 52. Channel and angle members 46 and 48 are secured to members 42 and 44 by means of a nut and bolt combination, with the shank of the bolt 54 extending through the space between structural members 42 and 44, so that by loosening the nuts and bolts angles and channel members 46 and 48 can be moved along the structural members 42 and 44 to adjust them to their desired position, and the nuts and bolts then tightened to fix them in that position.

Figure 6:
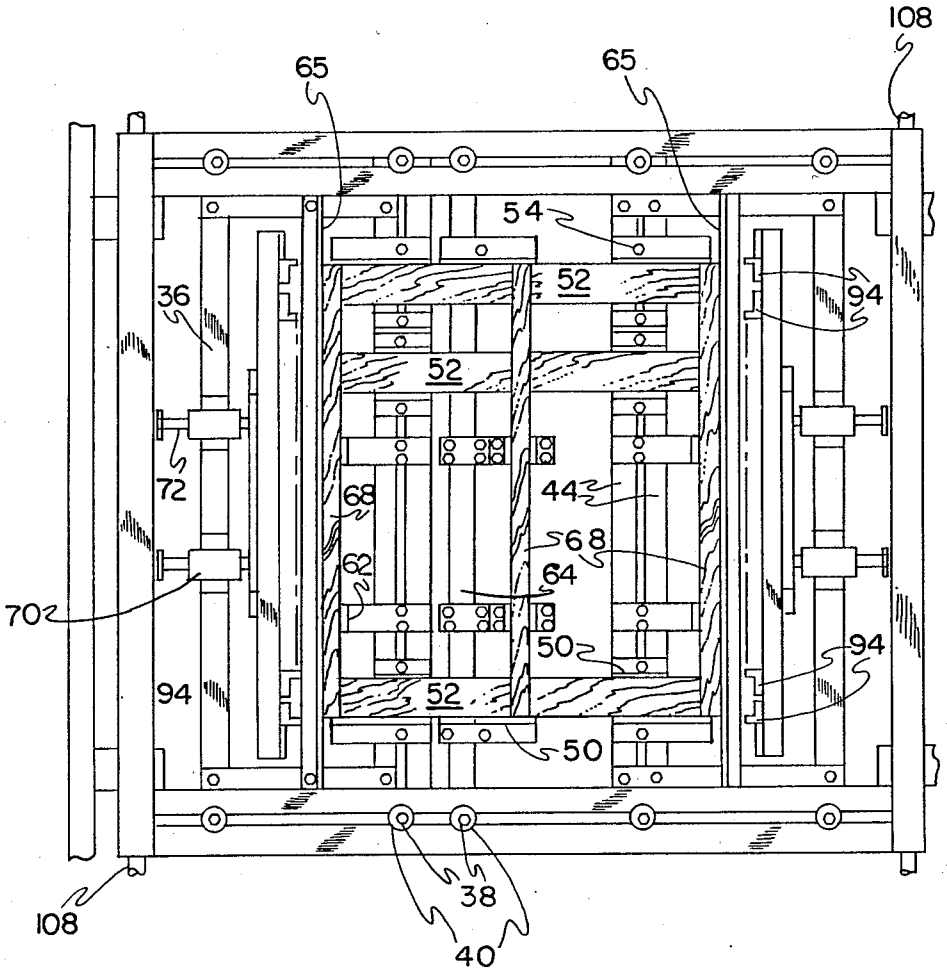
FIG. 6 is a view similar to FIG. 5, but showing the stringers received in their locators overlying the bottom slats.

Additional angle members 56 and 58 having upstanding flanges 60 and 62, respectively, are attached to the structural members 42 and 44 and to an additional structural member 64 extending parallel thereto. Upstanding flanges 60 and flanges 62 cooperating with longitudinally extending flanges 65 define a second set of locators for receiving, as seen in FIG. 6 of the drawings, longitudinally extending stringers 68.

Figure 9:
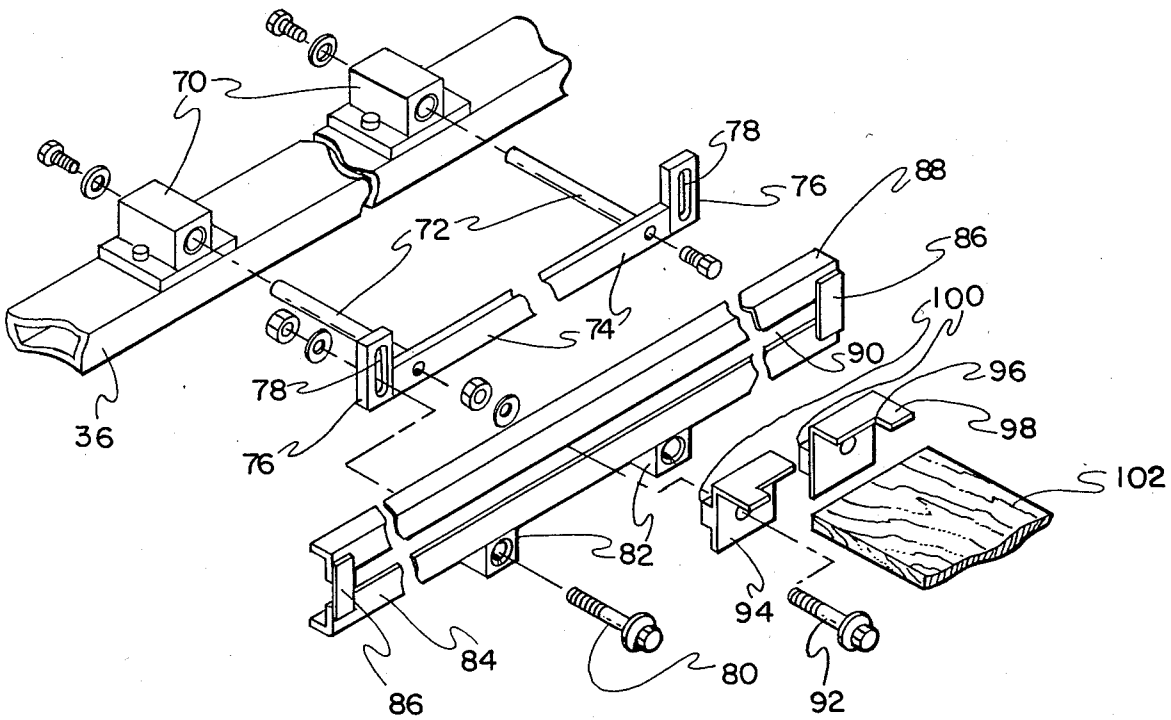
FIG. 9 is an exploded perspective view showing the mechanism for moving the top slat locators inwardly and outwardly between the positions shown in FIGS. 6 and 7 of the drawing.
Figure 10:
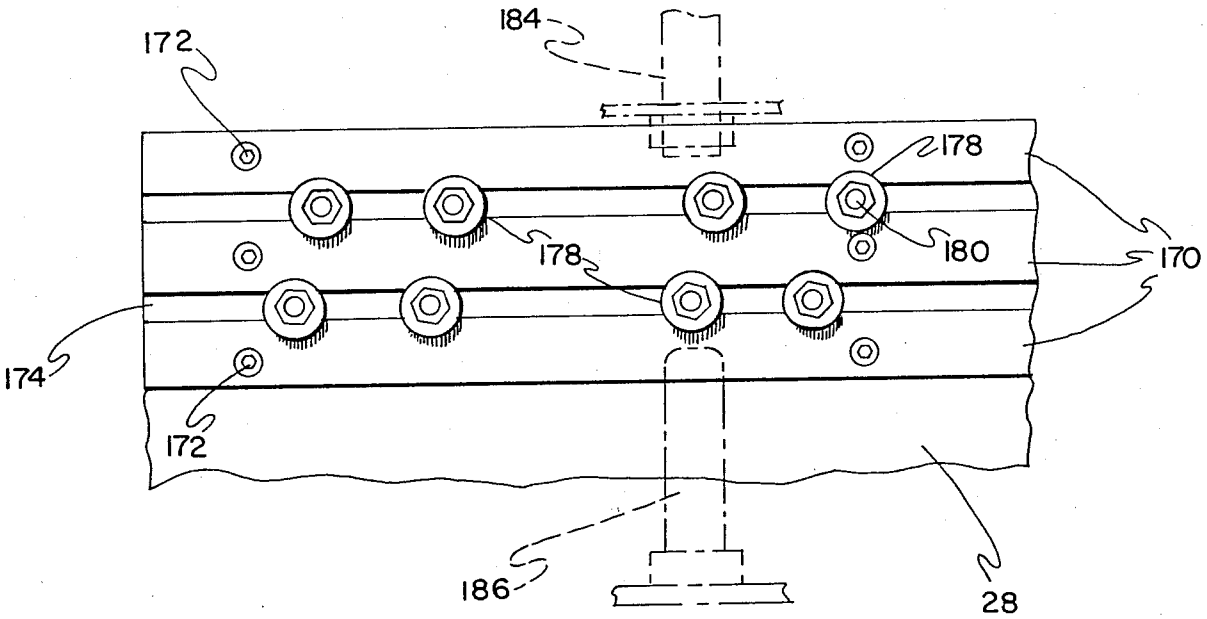
FIG. 10 is an elevational view on line 10—10 of FIG. 11, showing a side rail of the fixture carrying the actuating bosses and with the proximity switches in phantom.
Figure 11:
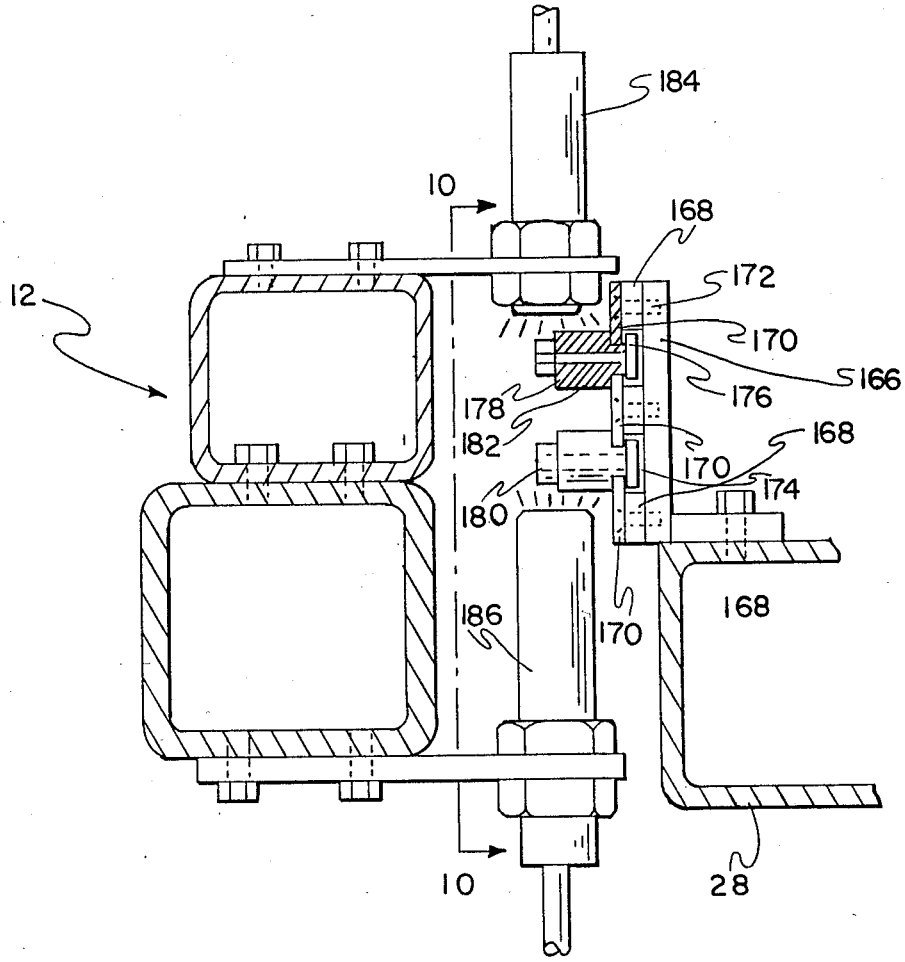
FIG. 11 is a cross-sectional view through a portion of the main supporting frame and fixture showing the actuating bosses and proximity switches.

With additional reference to FIG. 9 of the drawings, it will be seen that the secondary side rails 36 and 34 (only side rail 36 being shown in FIG. 9), carry guides 70, which in turn slidably receive rods 72, having fixed thereto at their outer ends a cross brace 74, which in turn has attached by welding or the like at each of its outer ends, vertically slotted adjusting members 76. Slots 78 in members 76 receive the shanks of bolts 80, only one of which is shown in FIG. 9, which pass through mounting bosses 82 secured by welding or the like to the lower flange of angle member 84. Straps 86 interconnect lower angle member 84 to an upper angle member 88, and the vertical flanges of each are spaced apart a distance to define a horizontal slot 90. Slot 90 receives the shanks of bolts 92, only one of which is shown, which also pass through angle members 94, each of which has a cut-out section 96 in its upper flange 98 and an outwardly protruding, substantially rectangular boss 100 which is slidably received in the slot 90.

With this construction it will be seen that members 94 can be adjusted longitudinally of the fixture with their cut-out portions 96 defining a third set of locators for the ends of top slats 102. The vertical slots 78 permit vertical adjustment of the third set of locators to accommodate slats of different thicknesses and stringers of different depths.

Figure 7:
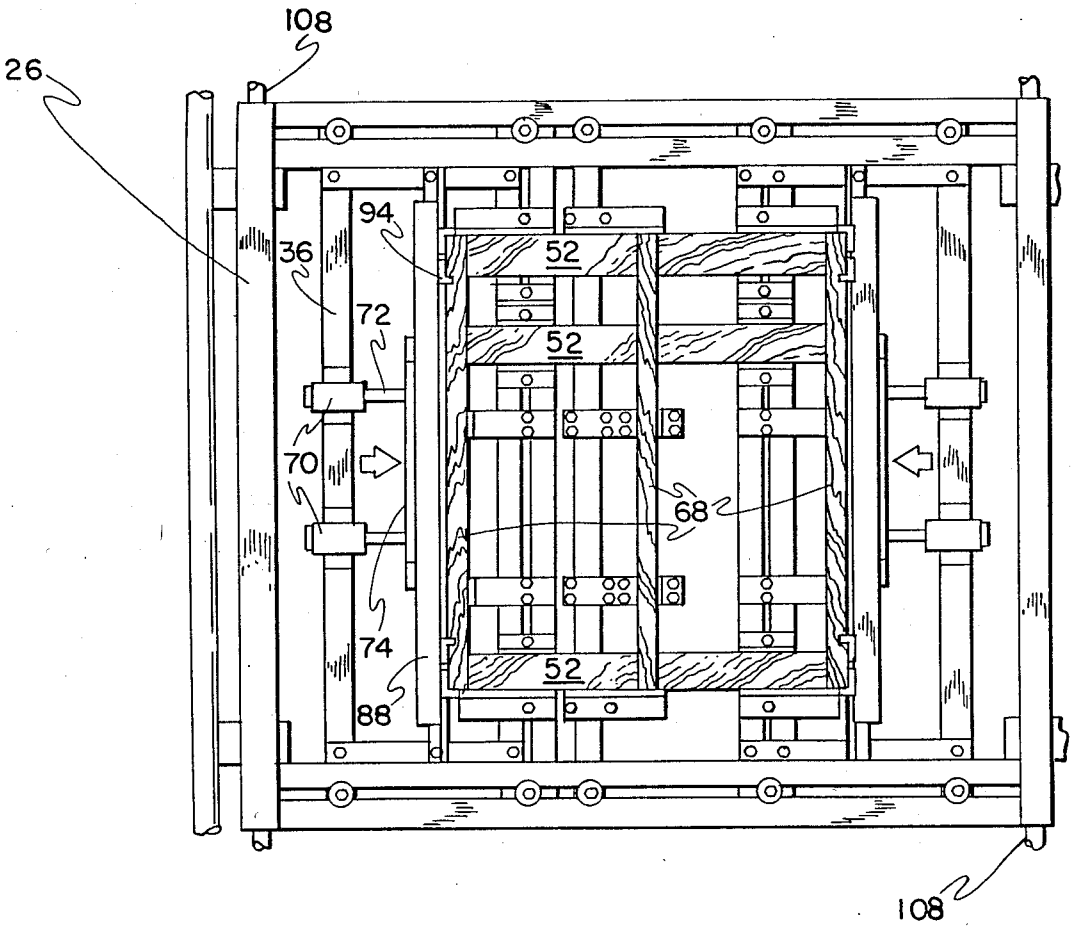
FIG. 7 is a further view of the fixture, but with the top slat locators moved inwardly to their slat receiving position.
Figure 8:
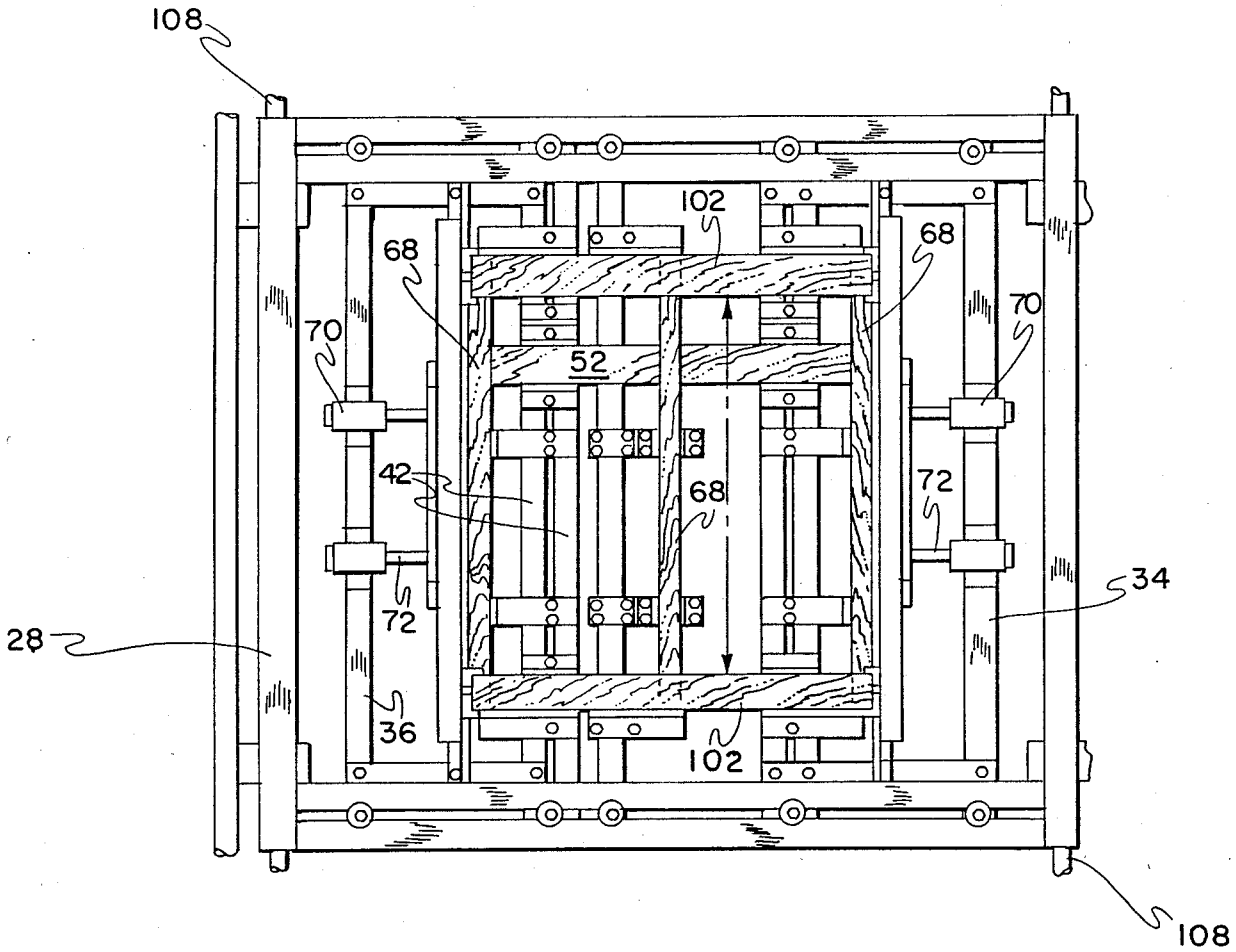
FIG. 8 is a view similar to FIG. 7 showing the installation of exemplary top slats.

The slidable mounting of the rods 72 permits the third set of locators to be moved laterally outwardly to facilitate loading of the bottom slats and the stringers, and thereafter the third set of locators may be moved inwardly, as seen in FIG. 7 of the drawings, to permit loading of the top slats 102 as seen in FIG. 8 of the drawings.

Figure 2:
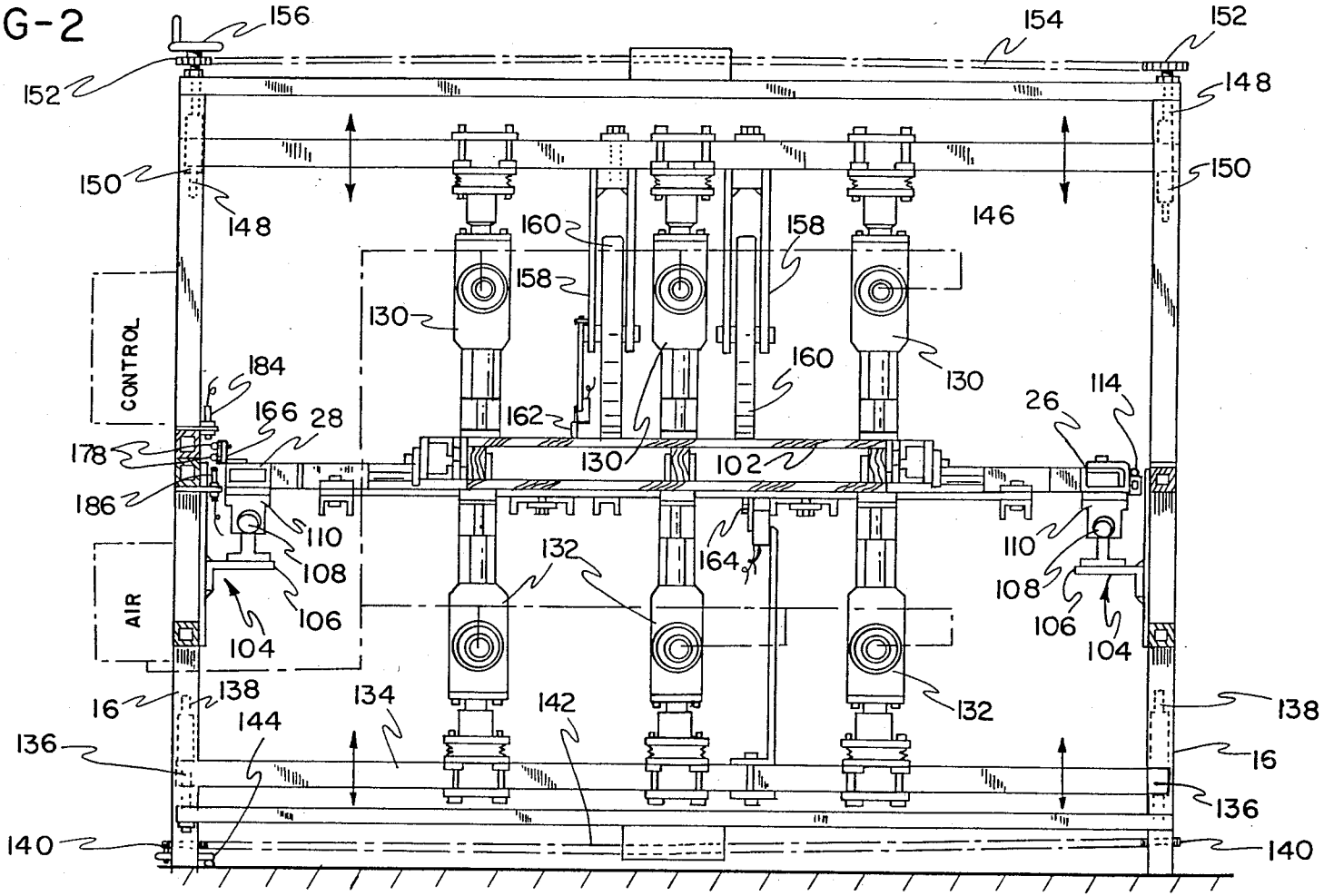
FIG. 2 is a cross-sectional view taken on line 2—2 of FIG. 1.
Figure 3:
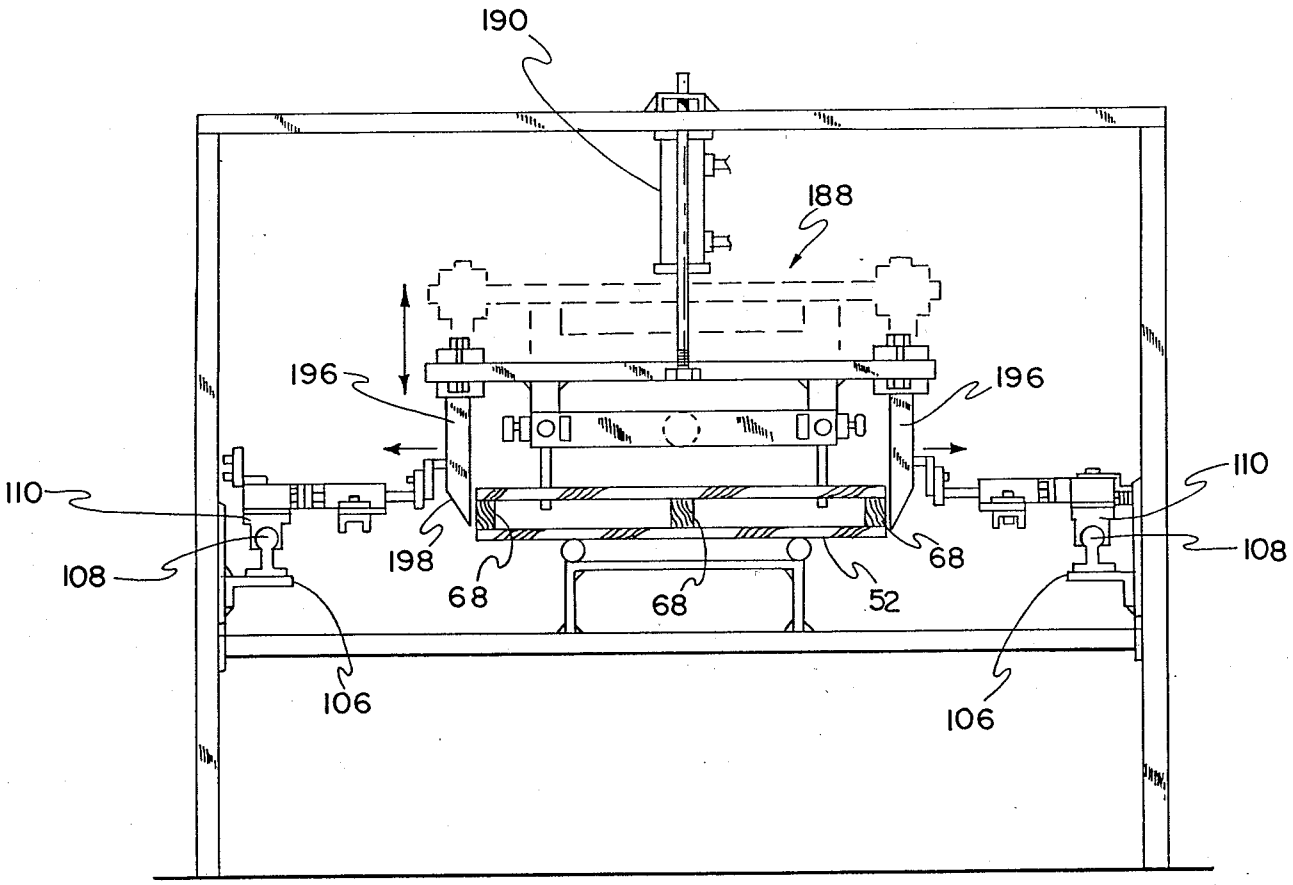
FIG. 3 is an end view taken on line 3—3 of FIG. 1.
Figure 4:
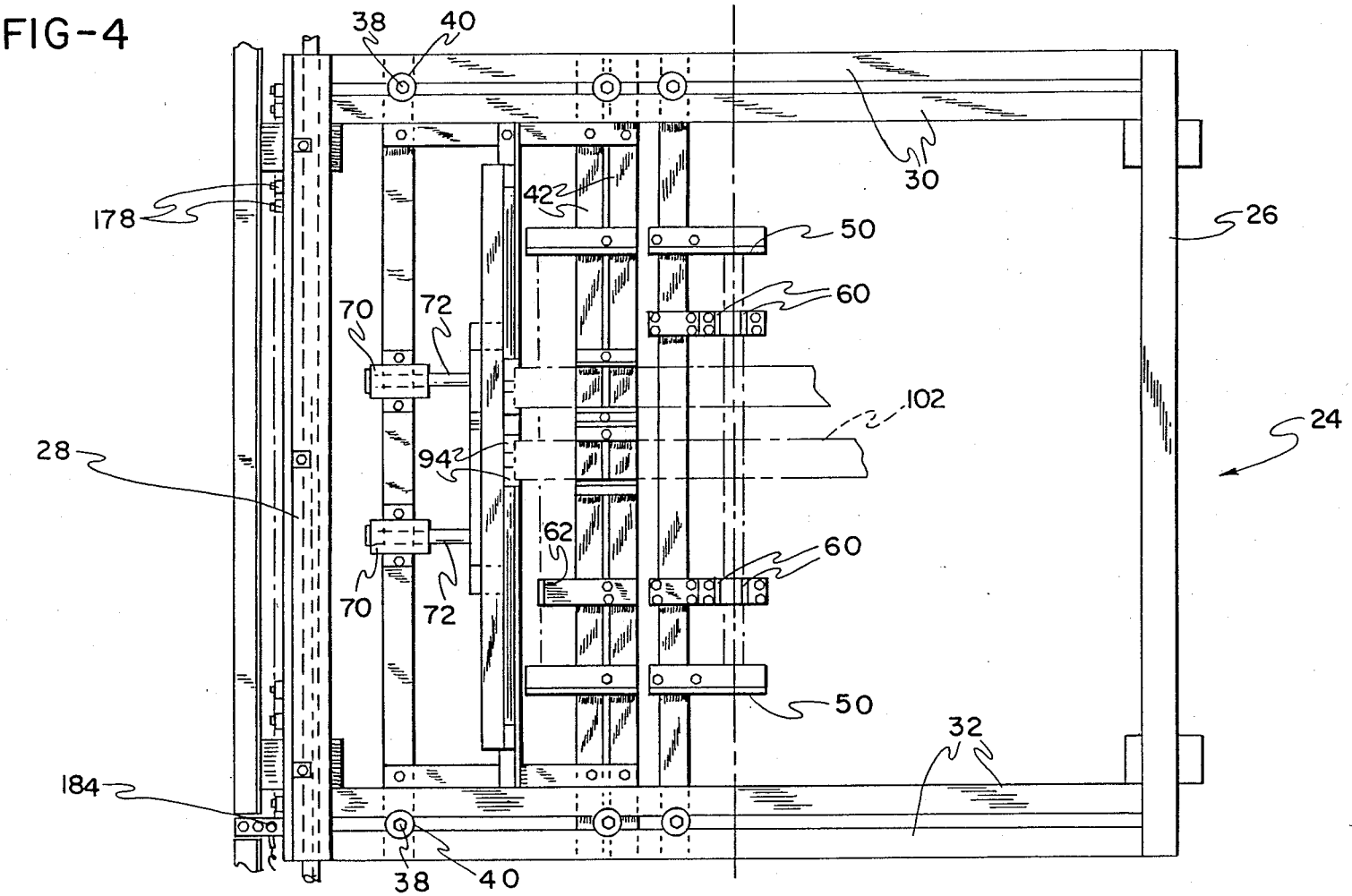
FIG. 4 is a plan view showing the fixture for receiving and stringers with portions broken away for clarity.
Figure 5:
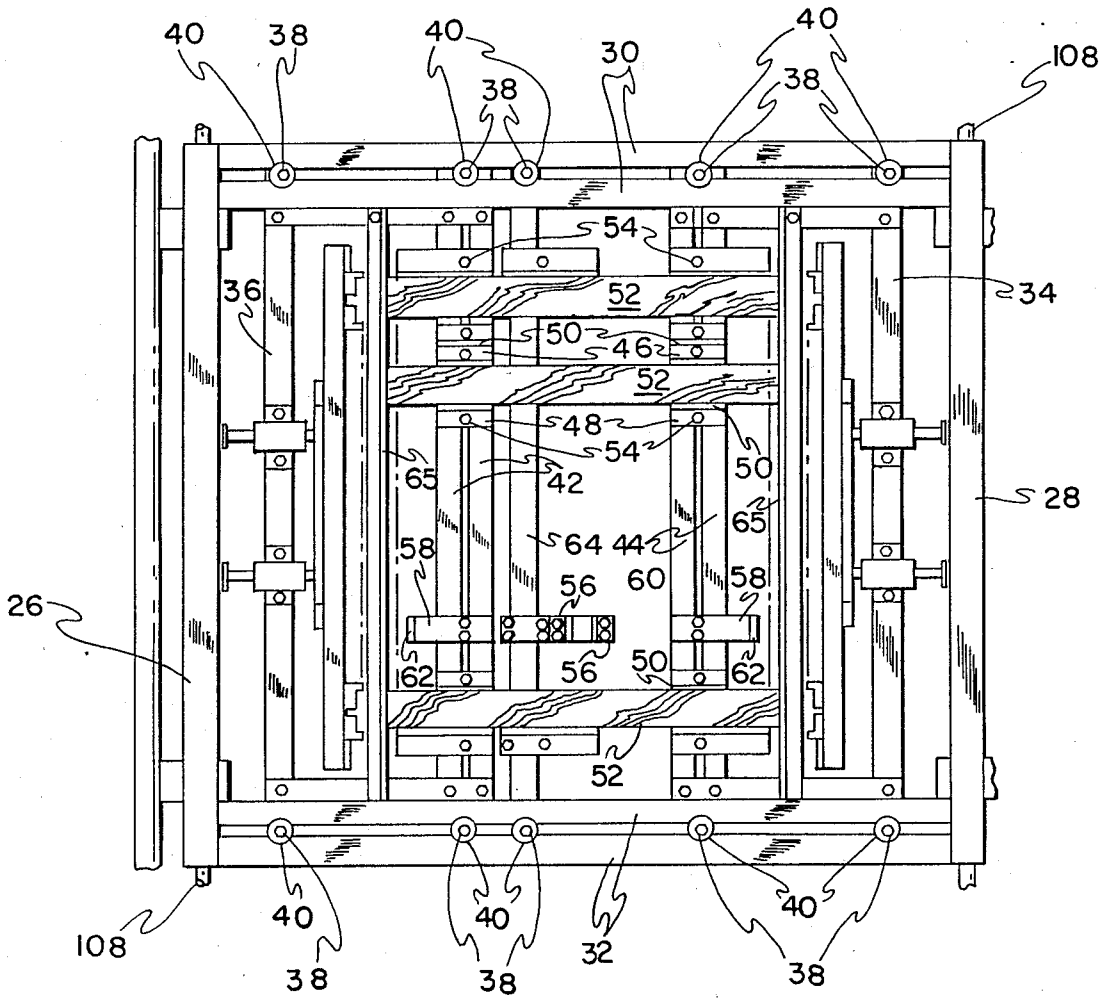
FIG. 5 is a plan view of the fixture with the bottom slats received in their locators.

The main frame 12 is provided with a plurality of brackets 104, as seen in FIGS. 2 and 3 of the drawings, each of which has a substantially horizontal leg 106 supporting parallel, longitudinally extending rails 108. Rails 108 slidably receive supports 110 secured to lower surfaces of the fixture 24 to permit slidable movement of the fixture along the rails from the loading station to the pickoff station shown in FIG. 1 of the drawings.

A chain drive, shown somewhat schematically at 112 in FIG. 1 of the drawings, is provided, with the ends of the chain fixed to the fixture 24 as indicated at 114 in FIG. 2 of the drawings and trained over chain wheels 116, 118 and 120 and a gear 122 driven by motor 124, all as seen in FIG. 1 of the drawings. Thus, motor 124 through the gear and chain drive described above moves the fixture 24 along the supporting rails 108.

With continued reference to FIG. 1 of the drawings, it will be seen that a hold-down clamp 126 may be positioned by the piston and cylinder combination 128 to be in sliding contact with the upper surfaces of the top slats 102 as the fixture 24 moves from the loading station to the nailing station.

At the nailing station upper and lower sets of nailing guns 130 and 132 are positioned to fire in unison nails into the top and bottom slats to attach them to the intervening stringers. Nailing guns 130 and 132 may be of a type commercially available and do not per se form part of tee present invention.

However, as seen in FIG. 2 of the drawings, the lower nailing guns 132 are mounted on a cross beam 134, which is provided at its ends with internally threaded members 136. Members 136 are in turn threadably received on vertically extending threaded rods 138 which are journaled in vertical structural members 16 and have attached at their lower ends chain wheels 140, about which is trained a chain 142. The left-hand threaded shaft 138, as seen in FIG. 2 of the drawings, also has fixed to its lower end a hand wheel 144, so that upon rotation of the hand wheel 144 both threaded shafts 138 are turned simultaneously to effect simultaneous raising and lowering of all of the lower nailing guns 132.

The upper nailing guns 130 are mounted on a cross beam 146, which at its outer ends loosely receives threaded shafts 148. In other words, there is no threaded connection between the ends of the cross beam 146 and the threaded shafts 148. However, internally threaded members 150, restrained against rotation, threadably engage the threaded shafts 148 and the outer ends of the cross beam 146 rest on the internally threaded members 150. At their upper ends the shafts 148 are provided with chain wheels 152, about which is trained a chain 154, and the upper end of the left-hand shaft 148 as seen in FIG. 2 of the drawings is provided with a hand wheel 156, so that upon rotation of the hand wheel 156 both members 150 will move upwardly or downwardly, depending upon the direction of rotation of the hand wheel 156, and effect raising or lowering of all of the upper nailing guns 130.

Also fixed to the cross beam 146 are brackets 158, each of which journals a wheel 160 which engages the upper surfaces of the top slats 102 as they move through the nailing station to position correctly the nailing guns with respect to the position of the top surfaces of each of the slats as they move through the nailing station. Thus, the nailing guns are initially positioned at approximately the correct height for the depth of the pallets to be run, and any variations from that height are compensated for by the engagement of the top surfaces of the slats 102 by the wheels 160, which, because the outer ends of the cross beam 146 are unthreaded, permit all of the guns to be lifted independently of the threaded members 150 to accommodate variations in the thickness of the pallet members.

It will also be noted from FIG. 2 of the drawings that detection switches 162 and 164 are mounted at the nailing station to detect the presence or absence of a slat at the position where a slat should be located as th pallet moves through the nailing station. If a slat is not in position to be nailed to the overlying or underlying stringer, as the case may be, switches 162 and/or 164 deactivate the circuit to the nailing guns and prevent them from being activated as they otherwise would be in a manner to be described presently.

With reference to FIGS. 2, 3, 10 and 11 of the drawings, it will be seen that the rail 28 has mounted thereon an upstanding, longitudinally extending plate member 166, which has attached to its outer face a plurality of relatively narrow straps 168 and somewhat wider but thinner straps 170 by means of bolts or the like 172. This construction defines a pair of longitudinally extending, T-shaped slots 174 that receive the heads of bolts 176 extending through bosses 178 and threadably receive nuts 180 on their outer ends. The bosses 178 are substantially cylindrical in shape, but have straight-sided, inwardly projecting portions 182 received in the narrower portions of the T-shaped slots 174. The bosses 178, may, therefore, be positioned along the rail 128 as desired, and in fact are positioned to correspond to each of the top and bottom slats carried by the fixture 24.

Mounted on the main frame 12 are upper and lower proximity switches 184 and 186, which are of conventional design and of the type that are actuated as each of the actuating bosses 178 passes past them, and the switches 184 and 186, through appropriate control circuitry, which may be of conventional design and does not per se form a part of the present invention, trigger the upper and lower sets of nailing guns 130 and 132 at the instant that an upper or lower slat, respectively, moves beneath or above, respectively, the nailing guns. Note, however, that even if a signal is received from the proximity switches to trigger the nailing guns, if the switches 162 and/or 164 do not detect a slat in position to be nailed, the circuit is deactivated for that particular slat and the guns will not fire.

Following nailing of the pallet components together, the fixture with the completed pallet moves into the pickoff station as seen in FIG. 1 of the drawings. At the pickoff station, as also seen in FIG. 3 of the drawings, is positioned a pickoff carriage 188 mounted for vertical movement by means of a cylinder and piston combination 190 and carrying arms 192 adapted to move inwardly into engagement with the leading and trailing top slats of a completed pallet under control of a horizontally acting piston and cylinder combination 194. It will also be noted from FIGS. 1 and 3 of the drawings that the pickoff carriage 188 is provided with fixed camming fingers 196, the lower surfaces of which ar sloped upwardly and outwardly, as at 198, whereby they may engage the upper angle members 88 (see also FIG. 9 of the drawings), to slide the third set of top slat receiving locators outwardly as the pickup arms move into position to clear the fixture for removal of the pallet therefrom upon upward movement of the carriage.

Thus, as the fixture 24 moves into the pickoff station the pickoff carriage descends, camming the third set of locators outwardly and positioning the arms for inward movement into engagement with lower surfaces of the top slats of the pallet, so that when the pickoff carriage is thereafter raised the completed pallet is freed from the fixture, permitting it to be returned to the loading station to receive another set of bottom slats, stringers, and after the third set of locators are manually moved inwardly, top slats.

Lastly, it will be noted that at either end of the main frame 12 limit switches 200 and 202 are positioned to terminate travel of the fixture along the rails 108, with the downstream switch 202 also serving to activate the motor 224, after a suitable dwell to permit removal of a finished pallet, to return the fixture back to the loading station.

With the above construction and with the fixture 24 located at the loading station, the bottom slats 52 are loaded into the fixture 24 utilizing the first set of locators defined by the upstanding flanges 50. Thereafter the stringers 68 are loaded manually using the second set of locators defined by the upstanding flanges 60, 62 and 64. The third set of locators, defined by the notches 96 are then moved inwardly to the position shown in FIG. 7 of the drawings, and the top slats 102 are manually loaded into fixture 24. The system is then energized, and through appropriate control circuitry, the motor 124 is activated, driving the fixture 24 down the rails 108 and past the nailing station, where the upper and lower guns 130 and 132 simultaneously nail each slat to the underlying or overlying surface of all of the stringers as each slat passes past the upper or lower bank of nailing guns. Actuation of the nailing guns is effected through passage of the actuating bosses 178 past the proximity switches 184 and 186, although, as noted previously, if the detection switches 162 and/or 164 fail to detect a slat in position for nailing, the firing circuit is deactivated for that particular position.

The motor 124 drives the fixture 24 with a continuous, non-intermittent motion down the rails 108 until the fixture trips the limit switch 202, terminating movement of the fixture and causing the pickoff carriage to move downwardly into position. Downward movement of the carriage cams the third set of locators outwardly add the pickup fingers thereafter move inwardly to engage the skid, following which the pickup carriage moves vertically upwardly to clear the pallet from the fixture, the fixture returns back to the loading station, the carriage moves downwardly again, the pickup fingers move outwardly to release the pallet and the carriage then moves back upwardly to its inactive position, ready for another pallet to be moved into position by the fixture.

As the fixture moves additional pallets from the loading station past the nailing station and into the pickoff station, it will slide out of the pickoff station the previously constructed pallet deposited there by the carriage onto rails or other suitable conveying mechanism, not shown, where the completed pallets will be assembled for shipment.

Additionally, the control circuitry may be set so that the fixture, after returning from the pickup station, will dwell at the loading station some preset interval of time sufficient to permit it to be reloaded prior to its automatically proceeding through the above described cycle. Alternatively, the system may be set up so that it is necessary for a cycle to be initiated by an operator after the operator is satisfied that the fixture has been properly loaded.

From the above it will be seen that the present invention provides a system which permits the production of pallets on a high volume basis, but without the necessity of expensive apparatus nor the use of excessive amounts of manual labor.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. Apparatus for assembling a pallet consisting of a plurality of laterally spaced, longitudinally extending, wooden stringers, laterally extending, longitudinally spaced, top and bottom slats, overlying top and bottom surfaces respectively, of said stringers, and a plurality of nails interconnecting said stringers and slats comprising.

a main supporting frame, a fixture having:

a first set of locators for receiving ends of said bottom slats and positioning them in desired, spaced relationship to each other, a second set of locators for receiving said stringers and positioning them in desired spaced relationship to each other and in substantially perpendicular, overlying relationship to said bottom slats, and a third set of locators for receiving ends of said top slats and positioning them in desired spaced relationship to each other, in overlying relationship to said stringers and bottom slats, and substantially perpendicularly with respect to said stringers, means for adjusting the positions of said locators with respect to each other, and means for moving said third set of locators laterally outwardly to facilitate loading of said first and second sets of locators, a nailing station mounted on said main frame medially thereof and having opposed pairs of upper and lower nailing guns equal in number to said stringers and spaced apart a distance equal to tee spacing of said stringers as they are received in said second plurality of locators, means for adjusting vertically said upper guns as a unit, means for adjusting vertically said lower guns as a unit, longitudinally extending rails mounted on said main frame and slidably supporting said fixture for longitudinal movement of said fixture between said opposed pairs of nailing guns, said rails extending upstream and downstream of said nailing station a distance at least equal to the length of said fixture, a chain drive mounted on said main frame for moving said fixture along said rails from a loading station upstream of said nailing station to a pickoff station downstream of said nailing station, a hold-down clamp mounted on said main frame and slidably engaging in its operative position top surfaces of said top slats as said fixture moves toward said nailing station, lowering and raising mechanism for raising and lowering said hold-down clamp from and to said operative position, a plurality of wheels interconnected to said upper nailing guns for vertical movement therewith and engaging said top surfaces of said top slats for positioning said upper nailing guns in desired relationship to said top surfaces of said top slats, actuating bosses positioned longitudinally along said fixture in a number corresponding to the number of top and bottom slats received in said fixture, upper and lower proximity switches positioned along said main frame in the path of said actuating bosses for actuation of said switches by said bosses as said fixture moves along said rails, control means for firing said nailing guns in response to actuation of said proximity switches by said actuating bosses, opposed slat detecting switches positioned upstream of said nailing station for detecting the presence or absence of a slat as said fixture moves into said nailing station and deactivating said nailing guns in response to the absence of a slat, a pickup carriage mounted for vertical movement downstream of said nailing station, pickup arms mounted on said pickup carriage for longitudinal movement into and out of engagement with a completed pallet, cam means carried by said carriage for vertical movement therewith and engageable with said means for moving said third set of locators laterally outwardly, and limit switches for terminating movement of said fixture along said rails at positions upstream and downstream of said nailing station.

2. Apparatus for assembling a pallet having longitudinally extending stringers and top and bottom slats attached to top and bottom surfaces, respectively, of said stringers comprising:

a main supporting frame, a loading station located at an upstream end of said main supporting frame, a nailing station located on said main supporting frame downstream of said loading station, a pickoff station on said main supporting frame downstream of said nailing station, a fixture movable along said main supporting frame from said loading station to said pickoff station, means for stopping said fixture at said loading station, means associated with said fixture for receiving while said fixture is positioned at said loading station said top and bottom slats and said stringers in substantially the final position they will occupy in a finished pallet, with said top and bottom slats extending transversely of and said stringers extending substantially parallel to the direction of movement of said fixture along said main supporting frame, means for moving said fixture with a continuous, unidirectional movement from said loading station, past said nailing station to said pickoff station, and a plurality of nailing guns mounted at said nailing station for sequentially nailing each of said top and bottom slats to said stringers as said fixture moves past said nailing station.

3. The apparatus of claim 2 wherein said fixture includes first, second and third sets of locators for receiving bottom slats, stringers and top slats, respectively, means is provided for adjusting the positions of said locators with respect to each other, and further comprising means for moving said third set of locators laterally outwardly to facilitate loading said bottom slats and stringers in said fixture.

4. The apparatus of claim 3 further comprising means associated with said pickoff station for camming said third set of locators laterally outwardly of said fixture.

5. The apparatus of claim 2 wherein said nailing guns comprise a plurality of opposed pairs of upper and lower nailing guns, and means associated with said upper nailing guns for engaging upper surfaces of slats received in said fixture for vertically positioning said upper nailing guns with respect to said upper surfaces of said slats as said fixture moves past said nail station.

6. The apparatus of claim 5 wherein said means associated with said upper nailing guns comprises a plurality of wheels interconnected to said upper nailing guns for vertical movement therewith and engaging said upper surfaces of said slats.

7. The apparatus of claim 2 further comprising a plurality of actuating bosses positioned along said fixture in a number corresponding to the number of top and bottom slats received in said fixture, upper and lower proximity switches positioned along said main supporting frame in the path of said actuating bosses for actuation of said switches by said bosses as said fixture moves along said rails, and control means for firing said nailing guns in response to actuation of said proximity switches by said actuating bosses.

8. The apparatus of claim 7 further comprising opposed slat detecting switches positioned upstream of said nailing station for detecting the presence or absence of a slat as said fixture moves into said nailing station and deactivating said nailing guns in response to the absence of a slat.

9. The apparatus of claim 2 further comprising a pickup carriage mounted for vertical movement at said pickup station, and pickup arms mounted on said pickup carriage for horizontal movement into and out of engagement with a completed pallet at said pickup station.

10. The apparatus of claim 2 further comprising a hold-down clamp mounted on said main frame and slidably engaging in its operative position upper surfaces of slats received in said fixture as said fixture moves into said nailing station.

11. The apparatus of claim 2 further comprising means for adjusting vertically said nailing guns.

12. The apparatus of claim 2 wherein said nailing guns are equal in number to the number of stringer received in said fixture and spaced apart a distance equal to the spacing of said stringers as they are received in said fixture.

13. Apparatus for assembling a pallet consisting of a plurality of laterally spaced, longitudinally extending, wooden stringers, laterally extending, longitudinally spaced, top and bottom slats overlying top and bottom surfaces, respectively, of said stringers, and a plurality of nails interconnecting said stringers and slats comprising:

a main supporting frame, a loading station located at an upstream end of said main supporting frame, a nailing station located downstream of said loading station, and a pickoff station located downstream of said nailing station, a fixture movable along said main supporting frame from said loading station to said pickoff station, means for stopping said fixture at said loading station to permit said slats and stringers to be loaded thereinto while said fixture is so stopped, said fixture including a first set of locators for receiving ends of said bottom slats and positioning them in desired, spaced relationship to each other extending transversely to the direction of movement of said fixture, a second set of locators receiving said stringers and positioning them in desired spaced relationship to each other and in substantially perpendicular, overlying relationship to said bottom slats, and a third set of locators for receiving ends of said top slats and positioning them in desired space relationship to each other, in overlying relationship to said stringers and bottom slats, and substantially perpendicularly with respect to said stringers, means for adjusting the positions of said locators with respect to each other, and means for moving said third set of locators laterally outwardly to facilitate loading of said first and second sets of locators, means for moving said fixture with a continuous, unidirectional movement from said loading station, past said nailing station and to said pickoff station, a plurality of opposed upper and lower nailing guns mounted at said nailing station, means for adjusting vertically said upper and lower nailing guns, a plurality of wheels interconnected to said upper nailing gun for vertical movement therewith and engageable with top surfaces of said top slats for vertically positioning Ⓡaid upper nailing guns in desired relationship to said top surfaces of said top slats, and control means for firing said nailing guns as said fixture moves past said nailing station.

14. The apparatus of claim 13 wherein said control means comprises actuating bosses positioned longitudinally along said fixture, and proximity switches positioned along said main frame in the path of said actuating bosses as said fixture moves along said main supporting frame.

15. The apparatus of claim 14 further comprising a pickup carriage mounted for vertical movement at said nailing station and including pickup arms mounted thereon for horizontal movement into and out of engagement with a completed pallet at said pickup station.

* * * * *